US007597599B1

(12) United States Patent
Boudreaux

(10) Patent No.: US 7,597,599 B1
(45) Date of Patent: Oct. 6, 2009

(54) SYSTEM FOR SEALING A KEEL COOLER TO A VESSEL HULL

(76) Inventor: Todd Boudreaux, P.O. Box 850, Bourg, LA (US) 70343

( * ) Notice: Subject to any disclaimer, the term of this patent is extended or adjusted under 35 U.S.C. 154(b) by 0 days.

(21) Appl. No.: 11/876,417

(22) Filed: Oct. 22, 2007

Related U.S. Application Data

(60) Provisional application No. 60/956,786, filed on Aug. 20, 2007.

(51) Int. Cl.

| | |
|---|---|
| ***F01P 3/20*** | (2006.01) |
| ***F28F 9/02*** | (2006.01) |
| ***F28F 9/04*** | (2006.01) |
| *B63H 21/14* | (2006.01) |
| *B63H 20/28* | (2006.01) |
| *B63H 21/10* | (2006.01) |

(52) U.S. Cl. ..... 440/88 HE; 440/88 C; 440/88 M; 440/88 R

(58) Field of Classification Search ..... 440/88 R, 440/88 C, 88 M, 88 HE; 165/44
See application file for complete search history.

(56) References Cited

U.S. PATENT DOCUMENTS

| | | | | |
|---|---|---|---|---|
| 1,000,310 | A | 8/1911 | Ward | |
| 2,258,526 | A | 10/1941 | Walter | |
| 2,382,218 | A | 8/1945 | Fernstrum | |
| 2,415,154 | A | 2/1947 | Walter | |
| 2,612,858 | A | 10/1952 | Mairs | |
| 2,682,852 | A | 7/1954 | Ruffolo | |
| 2,914,012 | A | 11/1959 | Godfrey et al. | |
| 3,177,936 | A | 4/1965 | Walter | |
| 3,561,524 | A | 2/1971 | Satterthwaite et al. | |
| 4,040,476 | A | 8/1977 | Telle et al. | |
| 4,043,289 | A | 8/1977 | Walter | |
| 4,338,993 | A | 7/1982 | Fernstrum | |
| 4,557,319 | A | 12/1985 | Arnold | |
| 5,931,217 | A | 8/1999 | Fernstrum | |
| 6,099,373 | A | 8/2000 | Fernstrum | |
| 6,575,227 | B1 * | 6/2003 | Leeson et al. | 165/44 |
| 6,830,218 | B2 * | 12/2004 | Kordel et al. | 244/132 |

FOREIGN PATENT DOCUMENTS

| | | |
|---|---|---|
| DE | 322789 | 7/1920 |
| GB | 434907 | 9/1935 |
| SU | 505874 | 7/1974 |

* cited by examiner

*Primary Examiner*—Lars A Olson
*Assistant Examiner*—Daniel V Venne
(74) *Attorney, Agent, or Firm*—Garvey, Smith, Nehrbass & North, L.L.C.; Gregory C. Smith

(57) ABSTRACT

An improved system for sealing a keel cooler to a hull of a vessel, of the type including a plurality of flow channels for exchanging heat between vessel water flowing in the channels and surrounding sea water; nozzles extending from ends of the keel cooler, for allowing the water to flow between the vessel and the keel cooler, companion fittings including at least one o-ring positioned on its inner wall, and including an opening for receiving each nozzle of the keel cooler; a bushing for allowing the o-ring of each nozzle and the o-ring of each fitting to seal against walls of each bushing; and each bushing having an eccentric circular wall, so that when the fitting openings on the hull are not the same distance apart as the nozzle openings, the bushing is rotatable to define a complete fluid seal.

21 Claims, 5 Drawing Sheets

SYSTEM FOR SEALING A KEEL COOLER TO A VESSEL HULL

CROSS-REFERENCE TO RELATED APPLICATIONS

This application claims priority from provisional patent application No. 60/956,786, filed Aug. 20, 2007 incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to keel coolers. More particularly, the present invention relates to a system for insuring that a keel cooler is properly sealed to the hull of a vessel, and compensating for any misalignment in the openings in the vessel hull and the nozzles on the keel cooler using bushings having eccentric wall thicknesses.

2. General Background

Keel coolers have been used for decades as a device for cooling a vessel's engine water in order to prevent the engine from overheating. The most common type of keel cooler, and one which has dominated the industry for decades, is a keel cooler manufactured by R. W. Fernstrum & Company, and which was the subject of U.S. Pat. No. 2,382,218 issued on Aug. 14, 1945. That keel cooler which is currently being sold today provides a heat exchanger portion positioned between a pair of header portions, each header having a threaded pipe connection for connecting onto the water cooling system of a vessel's engine when the keel cooler is secured to a marine hull structure. The keel cooler heat exchanger portion includes a plurality of parallel heat conduction tubes extending between the headers, so that as heated engine water enters into a first threaded pipe through the first header, the water travels through the plurality of spaced apart heating tubes. The heating tubes are submerged in the water in which the vessel is moored, so that as the hot engine water runs through the headers and the tubes, it exits through the second header, having exchanged a great deal of heat from the engine water into the surrounding ambient water. This type of heat exchanger is a very efficient, compact and dependable heat exchanger, hence its industry dominance for the past fifty years.

In mounting keel coolers to vessel hulls ideally the openings in the hull are precisely spaced so as to engage in fluid tight engagement the nozzles of the keel cooler being mounted. However, through human error, often times the openings are a millimeters off in spaced apart alignment, so that when the nozzles are inserted, there is less than a fluid tight fit, which creates leakage and other problems in setting the alignment straight. Therefore, there is a need in the industry to solve this very common problem.

SUMMARY OF THE PRESENT INVENTION

What is provided is an improved system for sealing a keelcooler to a hull of a vessel, including a keel cooler for mounting onto the vessel hull, of the type including a plurality of flow channels for exchanging heat between the vessel water flowing in the channels and the surrounding sea water; nozzles extending from first and second ends of the keelcooler, for allowing the water to flow between the vessel and the keelcooler, each nozzle including at least one o-ring positioned on its outer wall; companion fittings mounted on the vessel hull, each fitting including at least one o-ring positioned on its inner wall, and including an opening for receiving each nozzle of the keel cooler; a bushing positionable between each nozzle and each fitting, for allowing the o-ring of each nozzle and the o-ring of each fitting to seal against the inner and outer walls of each bushing; and each bushing further including an eccentric circular wall, insertable between each nozzle and each fitting so that in the event the fitting openings on the hull are not precisely the same distance apart as the nozzle openings on the keel cooler, the bushing is rotatable until the eccentric wall fully engages the o-rings of each nozzle and each fitting to define a complete fluid seal there between.

In other embodiments, the bushing would have the o-rings positioned in its walls, or the outer wall of the bushing would have o-rings, as would the outer wall of the nozzle of the keel cooler to effect the seal between the keel cooler and the vessel hull.

Therefore, it is a principal object of the present invention to provide an improved mounting for a keel cooler which facilitates fluid tight seals between the keel cooler and the hull of the ship in spite of slight discrepancies in the distance between the openings in the hull.

It is a further object of the present invention to provide an improved method to mount a keel cooler to a vessel hull through the use of an eccentric bushing to compensate for any discrepancy in the distance between the companion fittings on the vessel hull.

It is a further object of the present invention to provide the improved assembly to mount a keel cooler to a vessel hull wherein a bushing on each keel cooler nozzle defines a rotational eccentric configuration which seals by rotating of the bushing until the fluid seal is attained.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
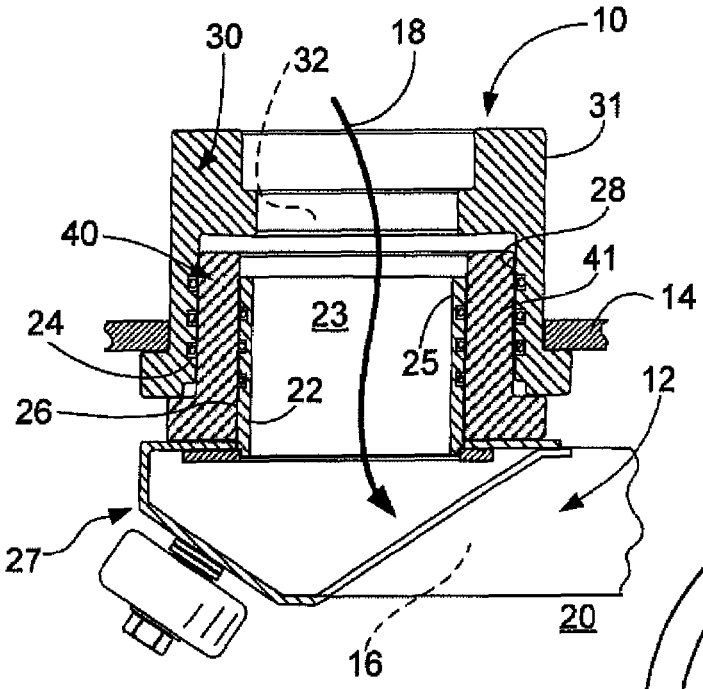
FIG. 1 illustrates a cross-section of the preferred embodiment of the sealing arrangement between the keel cooler and the vessel hull.
Figure 2:
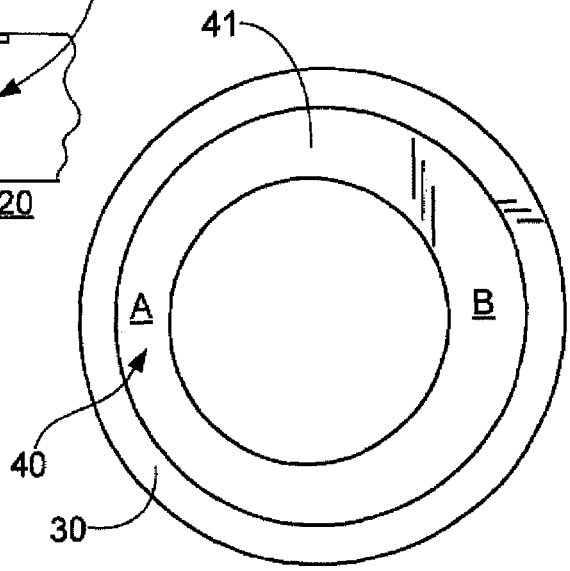
FIG. 2 illustrates a top view of the bushing element in the preferred embodiment of the present invention.
Figure 3:
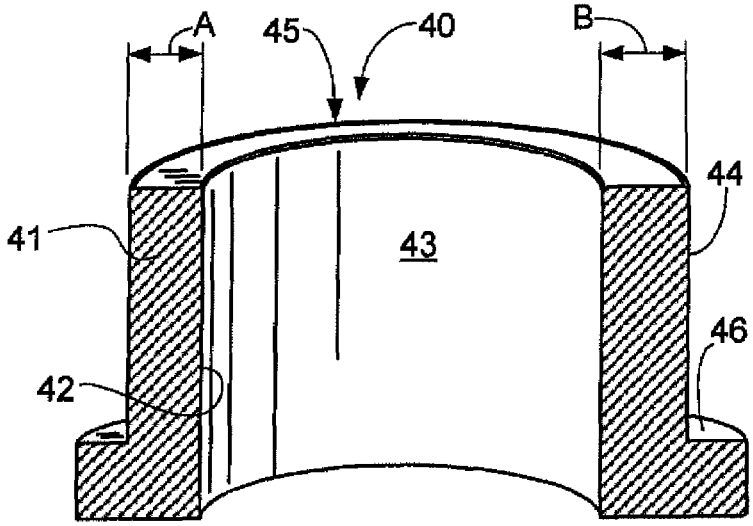
FIG. 3 illustrates a partial cutaway view of the bushing element in the preferred embodiment showing the eccentric wall configuration.
Figure 4:
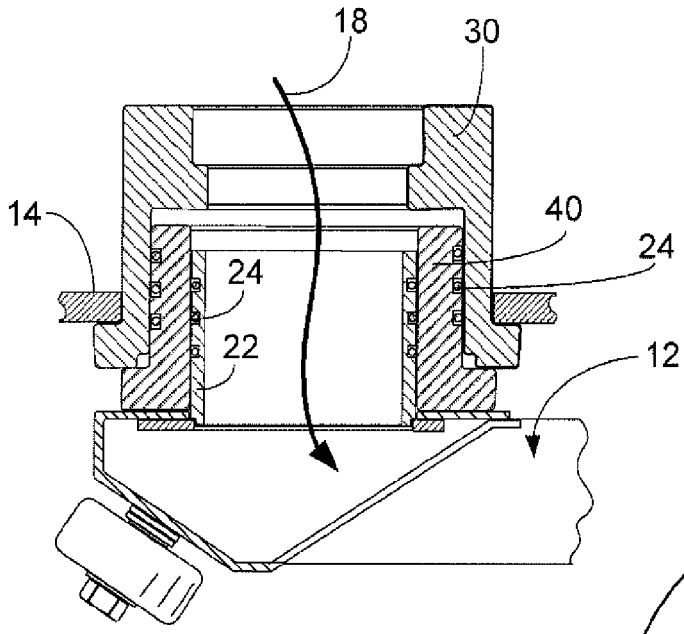
FIG. 4 illustrates a cross-section of a second embodiment of the sealing arrangement between the keel cooler and the vessel hull.
Figure 5:
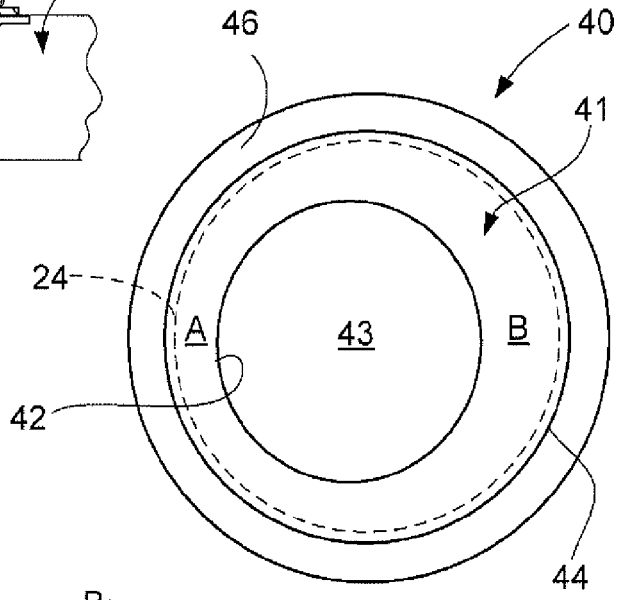
FIG. 5 illustrates a top view of the bushing element housed within a ship hull companion fitting.
Figure 6:
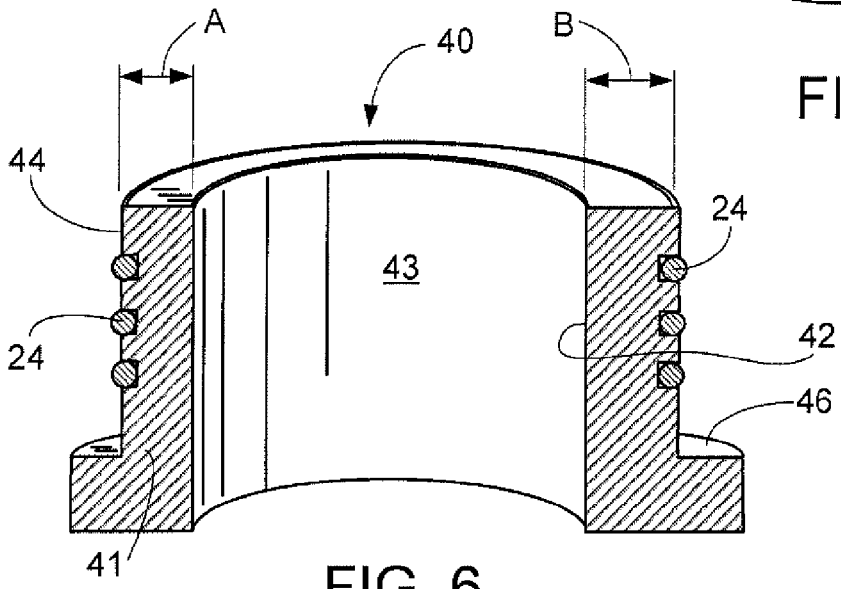
FIG. 6 illustrates a partial cutaway view of the bushing element o-rings in the second embodiment showing the eccentric wall configuration.
Figure 7:
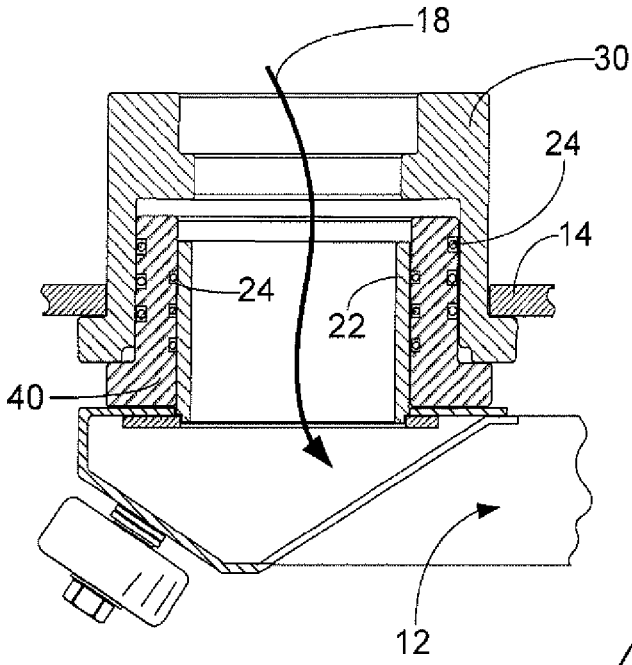
FIG. 7 illustrates a cross-section of a third embodiment of the sealing arrangement between the keel cooler and the vessel hull.
Figure 8:
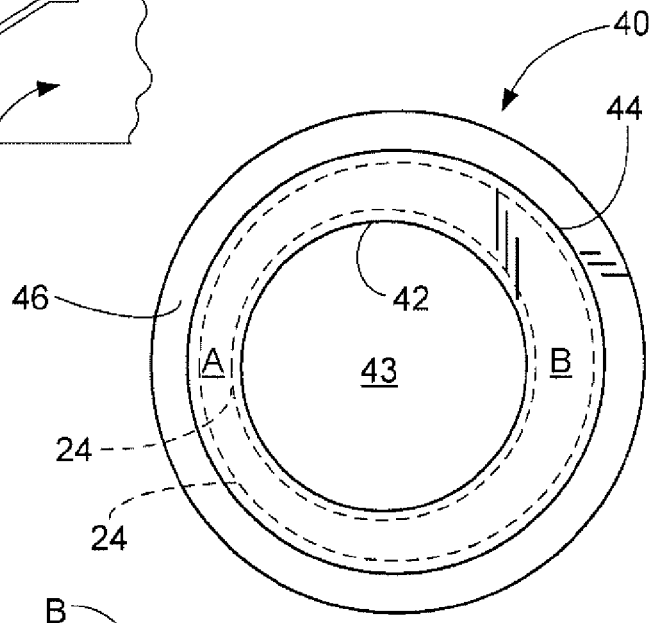
FIG. 8 illustrates a top view of the bushing element housed within a ship hull companion fitting in the third embodiment.
Figure 9:
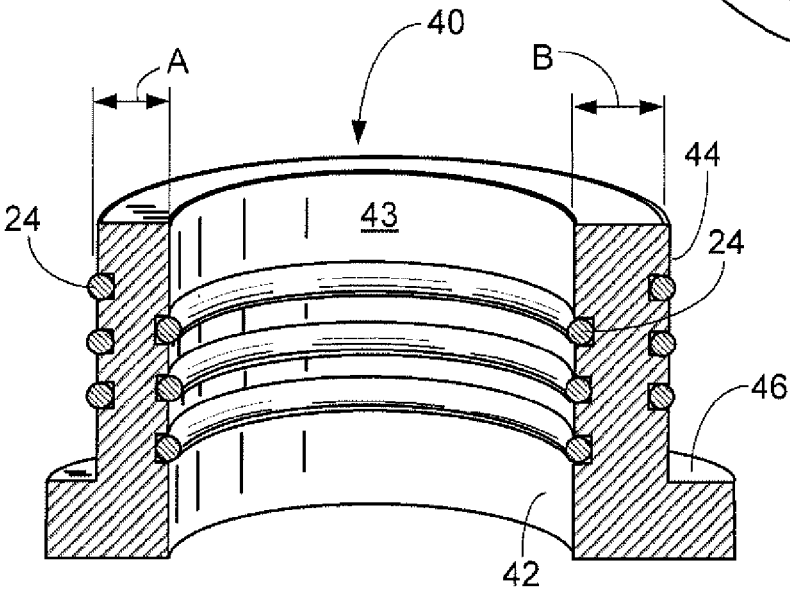
FIG. 9 illustrates a partial cutaway view of the bushing element in the third embodiment showing the eccentric wall configuration.
Figure 10:
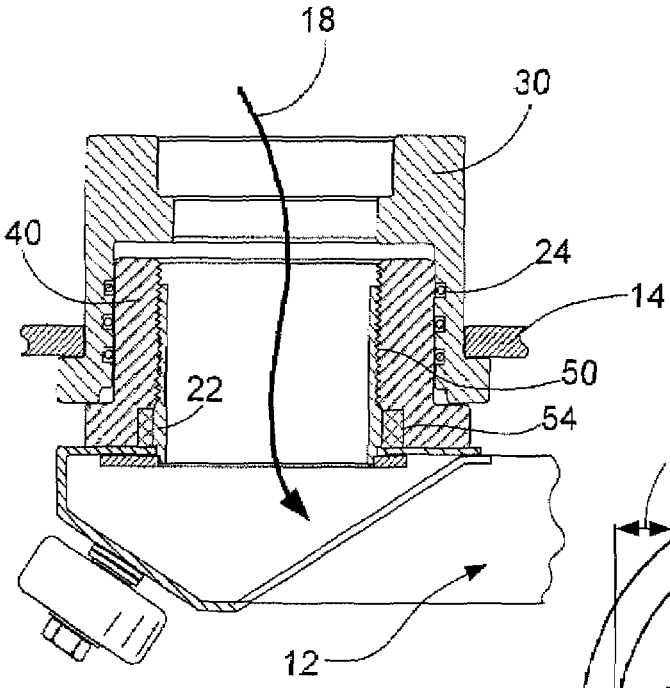
FIG. 10 illustrates a cross-section of a fourth embodiment of the sealing arrangement between the keel cooler and the vessel hull.
Figure 11:
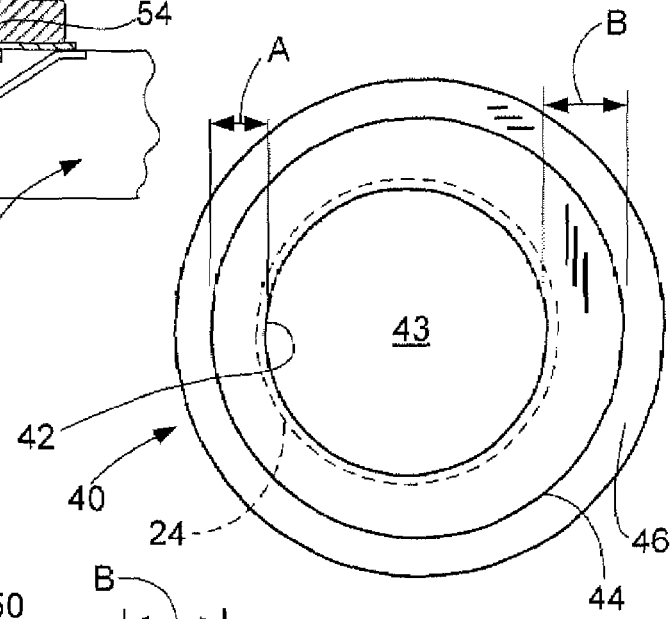
FIG. 11 illustrates a top view of the bushing element of the fourth embodiment housed within a ship hull companion fitting.
Figure 12:
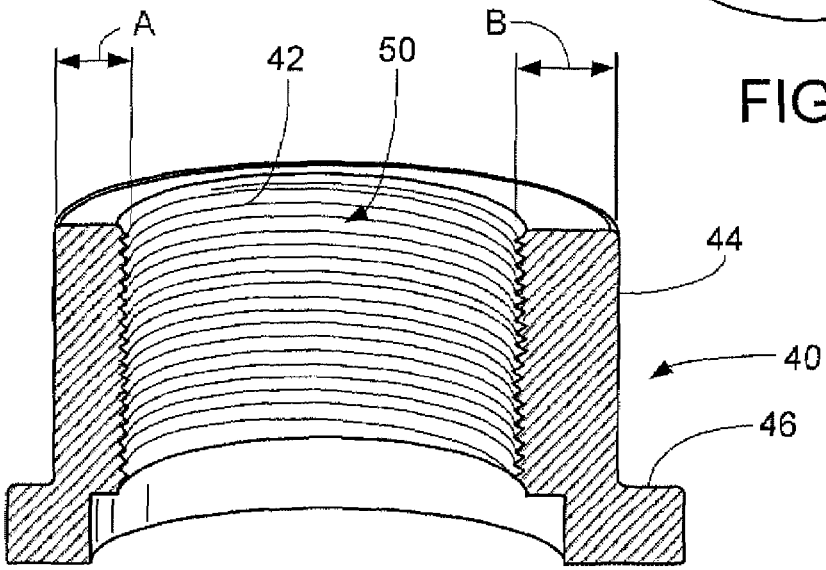
FIG. 12 illustrates a partial cutaway view of the bushing element of the fourth embodiment showing the eccentric wall configuration.

FIGS. 1 through 16 illustrate the various embodiments of the present invention, with FIGS. 1 through 3 illustrating the preferred embodiment; FIGS. 4 through 6 illustrating a second embodiment; FIGS. 7 through 9 illustrating a third embodiment; and FIGS. 10 through 12 illustrating a fourth embodiment. FIGS. 13 through 16 illustrate isolated views of certain parts of the present invention.

Turning now to the preferred embodiment in FIGS. 1 through 3, there is illustrated the preferred embodiment of the invention as seen by the numeral 10. What is provided is an improved system 10 for sealing a keel cooler 12 to a hull 14 of a vessel, including a keel cooler 12 for mounting onto the vessel hull 14, of the type including a plurality of flow channels 16 for exchanging heat between the vessel water (arrow 18) flowing in the channels 16 and the surrounding sea water 20. There is further illustrated nozzles 22 extending from first and second ends 27, 29 (See FIG. 13) of the keel cooler 12, for allowing the water 18 to flow through nozzle opening 23 between the vessel and the keel cooler 12. Each nozzle 22 would include an inner wall 25, and at least one o-ring 24 positioned on its outer wall 26. In the preferred embodiment, there would be placed three o-rings 24 on the outer wall 26. Additionally, although it is preferred to use o-ring seals, it is foreseen that any suitable sealing member which is capable of defining a fluid tight seal could be utilized.

There is further provided companion fittings 30 mounted on the vessel hull 14, each fitting 30 having an outer wall 31, and including at least one o-ring 24 positioned on its inner wall 28; although in the preferred embodiment three o-rings would be utilized. Each fitting 30 would include an opening 32 for receiving each nozzle 22 of the keel cooler 12.

As seen in FIGS. 2 and 3, there is further provided a bushing 40 positionable between each nozzle 22 and each fitting 30. Bushing 40 would include a base 46, supporting a circular body portion 45, with a continuous side wall 41 having an opening 43 therethrough; the side wall 41 having an inner surface 42 and an outer surface 44. The surfaces 42, 44 would allow the o-rings 24 of each nozzle 22 and the o-rings 24 of each fitting 30, to seal against the inner surface 42 and outer surface 44 of each bushing wall 41, respectively, as seen in FIG. 1.

Figure 15:
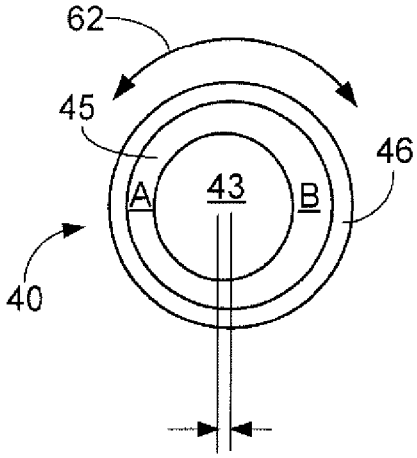
FIGS. 15 and 16 illustrate top views of the bushings being rotated in FIG. 14.
Figure 16:
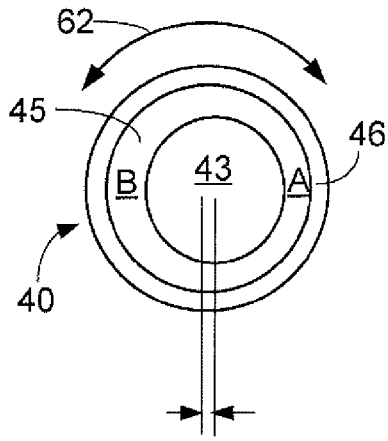

As seen clearly in FIG. 2, each bushing wall 41 is eccentric in thickness, defining a first thickness A and a second thickness B, forming the circular wall 41. As will be explained further, when the bushing 40 is inserted between each nozzle 22 and each fitting 30, in the event the fitting openings 32 on the hull 14 are not precisely the same distance apart as the nozzle openings 23 on the keel cooler 12, and an offset appears, which would not effect a fluid tight seal between the bushing walls and the walls of the nozzle 22 and the fitting 30, as is seen in FIGS. 15 and 16, the bushing 40 is rotatable until the eccentric wall 41 fully engages the o-rings 24 of each nozzle 22 and each fitting 30 to define a complete fluid seal therebetween.

FIGS. 4 through 6 illustrate a second embodiment of the system, which will function precisely as does the principal embodiment discussed above, except that the o-rings 24 are positioned on the outer surface 44 of each bushing 40 to seal against the inner wall 28 of each fitting 30, and the second set of o-rings 24 are positioned on the outer wall 26 of each nozzle 22, to seal against the inner surface 42 of each bushing 40. Like the preferred embodiment, the bushing wall 41 is eccentric in thickness, which allows a rotation of the bushing 40 within the fitting 30, to compensate for any offset which may occur, and effect a fluid seal. All other functions are identical.

It should be noted that in FIG. 4, although the o-rings 24 are shown in the outer wall of the nozzle 22, and in the outer wall of the bushing 40, the o-rings could be placed on the inner wall of bushing 40 instead of the outer wall of nozzle 22 to effect the seal. Likewise, the o-rings 24 in the outer wall of the bushing 40 could be placed in the inner wall of the fitting 30 instead of the bushing 40 and effect the same seal.

FIGS. 7 through 9 illustrate a third embodiment of the system, which will function precisely as does the principal embodiment discussed above, except that the o-rings 24 are positioned on the outer surface 44 of each bushing 40 to seal against the inner wall 28 of each fitting 30, and the second set of o-rings 24 are positioned on the inner surface 42 of each bushing 40, to seal against the outer wall 26 of each nozzle 22. Like the preferred embodiment, the bushing wall 41 is eccentric in thickness, which allows a rotation of the bushing 40 within the fitting 30, to compensate for any offset which may occur, and effect a fluid seal. All other functions are identical.

FIGS. 10 through 12 illustrate a fourth embodiment of the system, which will function precisely as does the principal embodiment discussed above, except that a first set of o-rings 24 are positioned on the inner wall 28 of each fitting 30 to seal against the outer surface 44 of each bushing 40, and the bushing 40 is threadably engaged via mating threads 50 onto each nozzle 22, and is sealing engaged to the outer wall 26 of each nozzle 22 through the use of a compressible sealing ring 54 at the base of the nozzle 22. Like the preferred embodiment, the bushing wall 41 is eccentric in thickness, which allows a rotation of the bushing 40 within the fitting 30, to compensate for any offset which may occur, and effect a fluid seal. All other functions are identical.

In FIG. 10, although the o-rings 24 are shown in the inner wall of the fitting 30 to seal against the bushing 40, instead, the o-rings could be placed in the outer wall of the bushing 40 to seal with the fitting 30 and achieve the same type of seal.

For a more full understanding of the important function of the bushing 40 as it functions in each of the four embodiments, reference is made to FIGS. 13 through 16. Although bushing 40 is illustrated as it is configured in the principal embodiment as seen in FIGS. 1 through 3, the operation and function of the bushing 40, in any of the four embodiments is substantially identical, in that it is the same eccentric wall thickness of the bushing which is critical to its function. Despite the fact that the bushing wall may include o-rings 24 in some of the other embodiments, or includes threads to its inner wall as seen in the fourth embodiment, the primary function of the bushing 40, does not change but remains the same for all embodiments.

Figure 13:
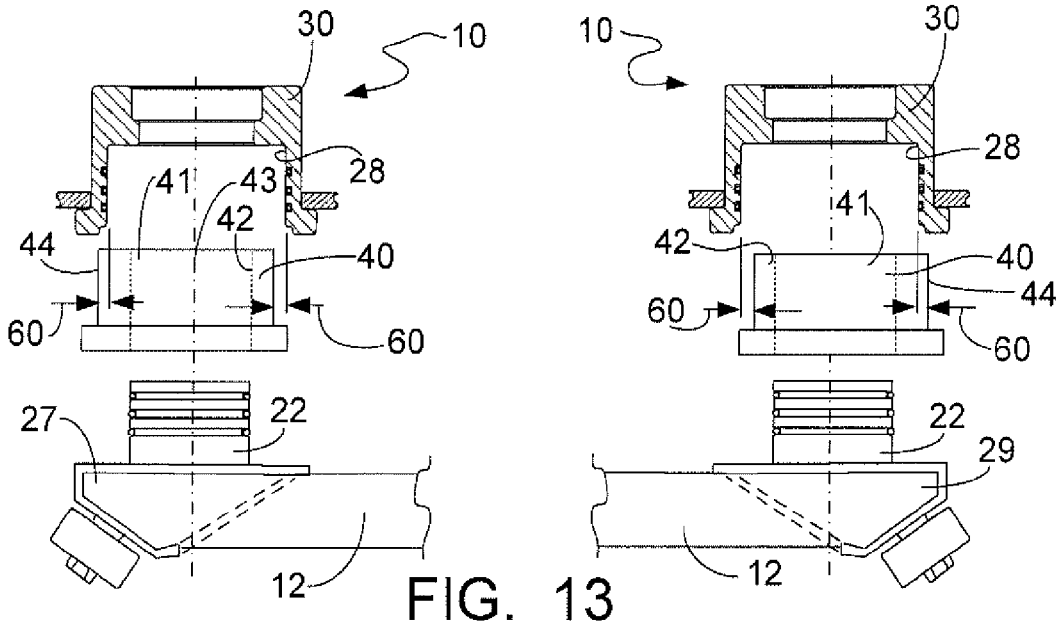
FIG. 13 illustrates an exploded view of the keel cooler mounting to the vessel hull in the preferred embodiment of the present invention, showing misalignment between the keel cooler and the openings in the ship's hull.

Now turning to FIGS. 13-16, there is illustrated in FIG. 13 the partial keel cooler 12, having a first end 27 and second end 29, each of the ends 27, 29 having a nozzle 22 extending therefrom upward which will be accommodated into a companion fittings 30 as illustrated. Intermediate companion fittings 30 and each nozzle 22 would be the bushing 40, including a circular wall 41, defining an opening 43 therethrough, the wall 41 having an outer surface 44 which mates with the inner surface 28 of the companion fitting 30, and an inner surface 42 which mates with the outer surface of each nozzle 22, as was explained earlier, with the o-rings 24 accomplishing the fluid tight seal between the three elements. In a perfect alignment, the nozzles 22 of the keel cooler 12 would have an exact fit into each of the companion fittings 30 and would need no adjustment whatsoever. However, given the fact that the openings in the ship hull 14 are measured as carefully as possible, prior to being formed, when a keel cooler 12 is placed against these openings oftentimes there is a several millimeters errors so that the nozzles 22 would not fit directly into each of the companion fittings 30. This offset position is illustrated in FIG. 13 by arrows 60, and needs to be realigned in order to fit properly.

Figure 14:
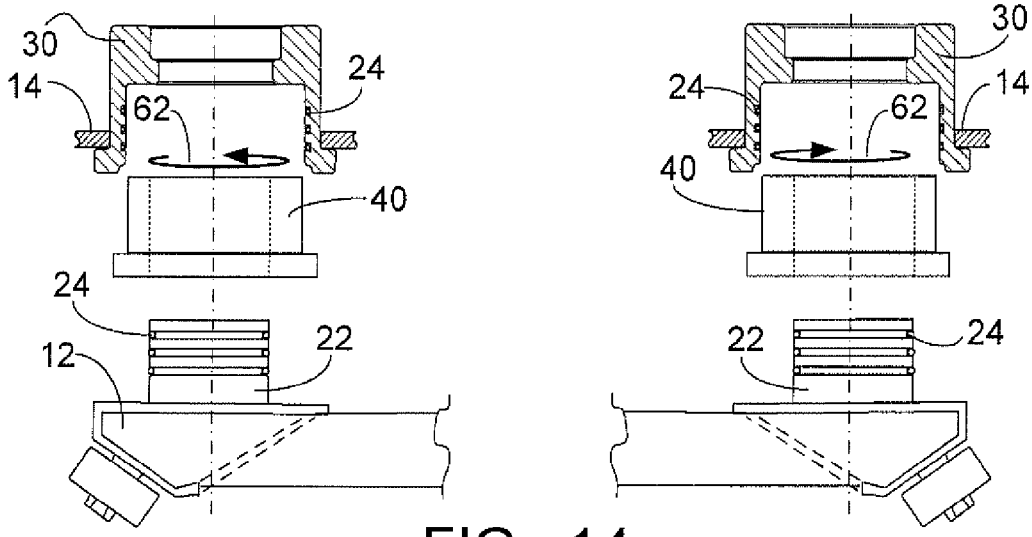
FIG. 14 illustrates an exploded view of the keel cooler mounting to the vessel hull in the preferred embodiment of the present invention, wherein the rotation of the rotation of the bushing brings the keel cooler and openings in the ship's hull into alignment.

As seen in the FIG. 14, because of the eccentric wall thickness of wall 41, represented by A and B in the figures, each of the bushings 40 would be rotated in the direction of arrows 62, (or whatever direction would be required) which would allow the offset gap (shown by arrows 60 in FIG. 13) formed in the offset alignment discussed in FIG. 13, the bushing wall 41 would naturally fill the offset and would effect the fluid tight seal desired between the nozzles 22, the bushing 40 and the companion fittings. This rotation is also depicted in FIGS. 15 and 16, which illustrate in top view each bushing 40 being rotated to fill the unwanted gap between the bushing 40 and the companion fitting 30.

Stated another way, this eccentric wall thickness of the bushing wall 41 would allow that once the bushing 40 is set in place between the nozzles 22 and companion fittings 30, the rotation of bushing 40 provides a means to fill any gap between the bushing 40 and nozzles 22 and companion fittings 30 which may be the result of slightly off target openings in the ship's hull 14, and upon rotation of bushing 40, a fluid tight seal is then formed between the bushing 40, the nozzles 22 and the companion fittings 30 through o-rings 24. The bushings 40, once in place, may be rotated manually or rotated through natural movement as the nozzles 22 are fitted into the companion fittings 30 so that if there is a gap created between the walls of the three fittings, the rotation of the bushings 40 would naturally fill that gap and would allow there to ultimately be a fluid tight seal as seen by arrows 62, in FIGS. 15 and 16. Without the use of the bushing 40 with the eccentric circular wall 41, it would be virtually impossible to assure that there would be a fluid tight seal every time a keel cooler 12 is placed into a ships hull 14. However, with the use of the bushing 40, and the ability for the bushing to rotate within its position between the nozzles 22 and companion fittings 30, the bushing would be capable of rotating so that there would be assured a fluid tight seal throughout the entire surfaces between the three fittings.

For purposes of construction, although o-rings are discussed in the specification, any flexible sealing member could be utilized as long as it effected the necessary fluid seal. Likewise the materials may be any type of metal or other materials in the components of the system.

The following is a list of parts and materials suitable for use in the present invention.

PARTS LIST

| Part Number | Description |
|---|---|
| 10 | system |
| 12 | keel cooler |
| 14 | hull |
| 16 | flow channels |
| 18 | arrow |
| 20 | sea water |
| 22 | nozzles |
| 23 | nozzle opening |
| 24 | o-ring |
| 25 | inner wall |
| 26 | outer wall |
| 27 | first end |
| 28 | inner wall |
| 29 | second end |
| 30 | companion fittings |
| 31 | outer wall |
| 32 | opening |
| 40 | bushing |
| 41 | bushing wall |
| 42 | inner surface |
| 43 | bushing opening |
| 44 | outer surface |
| 45 | bushing body |
| 46 | bushing base |
| 50 | threads |
| 54 | ring |
| 60 | arrows |
| 62 | arrows |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. An improved system for sealing a keel cooler to a hull of a vessel, comprising:

a. a keel cooler for mounting onto the vessel hull, of a type including a plurality of flow channels for exchanging heat between vessel water flowing in the flow channels and surrounding sea water;

b. nozzles extending from first and second ends of the keel cooler, for allowing the sea water to flow between the vessel and the keel cooler, each nozzle including at least one sealing member positioned on an outer wall of the nozzle;

c. companion fittings mounted on the vessel hull, each companion fitting including at least one sealing member positioned on its inner wall, and including an opening for receiving each nozzle of the keel cooler;

d. a bushing positionable between each nozzle and each companion fitting, for allowing the at least one sealing member of each nozzle and the sealing member of each companion fitting to seal against inner and outer surfaces of a wall of each bushing; and e. each bushing wall further defining an eccentric circular wall, insertable between each nozzle and each companion fitting so that in the event the companion fitting openings on the hull are not precisely the same distance apart as nozzle openings on the keel cooler, the bushing is rotatable until the eccentric circular wall fully engages the at least one sealing members of each nozzle and each companion fitting to define a complete fluid seal therebetween.

2. The system in claim 1, wherein the at least one sealing member on the outer wall of the each nozzle include an o-ring or any other sealing member capable of effecting a fluid tight seal.

3. The system in claim 1, wherein the at least one sealing member on the wall of each of the companion fittings include o-rings or any other sealing member capable of effecting a fluid tight seal.

4. The system in claim 1, wherein there is provided at least three sealing members along the outer wall of the nozzles.

5. The system in claim 1, wherein there are provided at least three sealing members along the wall of the companion fittings.

6. An improved system for sealing a keel cooler to a hull of a vessel, comprising:

a. a keel cooler for mounting onto the vessel hull, of a type including a plurality of flow channels for exchanging heat between vessel water flowing in the flow channels and surrounding sea water;

b. nozzles extending from first and second ends of the keel cooler, for allowing the sea water to flow between the vessel and the keel cooler, each nozzle having at least one sealing member on an outer wall of the nozzle;

c. companion fittings mounted on the vessel hull, each fitting having an opening for receiving the nozzles of the keel cooler;

d. a bushing, having a wall with inner and outer surfaces, the outer surface having at least one sealing member, the bushing mountable between a wall of each nozzle and a wall of each companion fitting, to provide a fluid seal between inner and outer surfaces of the bushing, and the nozzle and the companion fitting; and e. the wall of each bushing further comprising an eccentric circular wall, insertable between each nozzle and each companion fitting so that in the event the openings in the fittings on the hull are not precisely the same distance apart as nozzle openings on the keel cooler, the bushing is rotatable until the sealing members positioned in the eccentric circular wall fully engages the wall of each nozzle and the wall of each companion fitting to define a complete fluid seal therebetween.

7. The system in claim 6, wherein the sealing members on the wall of the nozzles include o-rings or any other sealing member capable of effecting a fluid tight seal.

8. The system in claim 6, wherein the sealing members on the wall of the bushing include o-rings or any other sealing member capable of effecting a fluid tight seal.

9. The system in claim 6, wherein there are provided at least three sealing members along the wall of the nozzles.

10. The system in claim 6, wherein there are provided at least three sealing members along the wall of the bushings.

11. An improved system for sealing a keel cooler to a hull of a vessel, comprising:

a. a keel cooler for mounting onto the vessel hull, of a type including a plurality of flow channels for exchanging heat between vessel water flowing in the channels and surrounding sea water;

b. nozzles extending from first and second ends of the keel cooler, for allowing the sea water to flow between the vessel and the keel cooler, c. companion fittings mounted on the vessel hull, each fitting having an opening for receiving each nozzle of the keel cooler;

d. a bushing mountable between a wall of each nozzle and a wall of each companion fitting, outer and inner surfaces of the wall of the bushing having at least a sealing member to provide a fluid seal between the bushing and an outer wall of the nozzle and an inner wall of the companion fitting providing a fluid tight seal; and e. each bushing wall further defining an eccentric circular configuration, insertable between each nozzle and each companion fitting so that in the event the openings in the companion fittings on the hull are not precisely the same distance apart as the nozzle openings on the keel cooler, the bushing is rotatable until the eccentric wall fully engages the sealing member of each nozzle and each companion fitting to define a complete fluid seal therebetween.

12. The system in claim 11, wherein the sealing member on each bushing wall includes an o-ring or any other sealing member capable of effecting a fluid tight seal.

13. The system in claim 11, wherein there are provided at least three sealing members along the both the inner and outer walls of the bushings to effect the fluid tight seal.

14. An improved system for sealing a keel cooler to a hull of a vessel, comprising:

a. a keel cooler for mounting onto the vessel hull, of a type including a plurality of flow channels for exchanging heat between vessel water flowing in the channels and surrounding sea water;

b. nozzles extending from first and second ends of the keel cooler, for allowing the sea water to flow between the vessel and the keel cooler;

c. a bushing threadably engaged to a wall of each nozzle, and including a sealing ring positioned between the wall of the nozzle and the bushing to effect a fluid seal when the bushing is fully threaded onto each nozzle;

d. companion fittings mounted on the vessel hull, including an opening for receiving each nozzle of the keel cooler, each companion fitting including at least one sealing member positioned on an inner wall of each companion fitting for sealing against an outer wall of each bushing when the keel cooler is positioned onto the hull of the vessel; and e. each bushing further comprising an eccentric circular wall, insertable between each nozzle and each companion fitting so that in the event the openings on the companion fittings on the hull are not precisely the same distance apart as the nozzle openings on the keel cooler, the bushing is rotatable until the eccentric wall fully engages the sealing members of each nozzle and each companion fitting to define a complete fluid seal therebetween.

15. The system in claim 14, wherein at least one sealing member on the wall of each companion fitting include an o-ring or any other sealing member capable of effecting a fluid tight seal.

16. The system in claim 14, wherein there are provided at least three sealing members along the walls of the companion fittings to effect the fluid tight seal.

17. An improved system for sealing a keel cooler to a hull of a vessel, the keel cooler of the type including a plurality of flow channels for exchanging heat between vessel water flowing in the flow channels and surrounding sea water; nozzles extending from first and second ends of the keel cooler, for allowing the seawater to flow between the vessel and the keel cooler; companion fittings mounted on the vessel hull, including an opening for receiving each nozzle of the keel cooler; the improvement comprising:

a. a bushing, comprising an eccentric circular wall sealingly insertable between each nozzle and each companion fitting so that in the event the openings in the companion fitting on the hull are not precisely the same distance apart as the nozzle openings on the keel cooler, the bushing is rotatable until the eccentric circular wall fully engages and provides a fluid seal between each bushing and each nozzle and each fitting; and b. sealing members engaged between a wall of each bushing and a wall of each nozzle and a wall of each companion fitting to effect the fluid tight seal upon rotation of the bushing.

18. The system in claim 17, wherein the sealing member between the walls of each nozzle and the walls of each companion fitting and the walls of each bushing include at least one o-ring or any other sealing member capable of effecting a fluid tight seal between the three members.

19. The system in claim 17, wherein there are provided at least three sealing members between the walls of each nozzle and each companion fitting and each bushing to effect the fluid tight seal between the three members.

20. The system in claim 17, wherein there is threaded engagement between each bushing and each nozzle, with a sealing ring effecting the fluid tight seal therebetween.

21. An improved system for sealing a keel cooler to a hull of a vessel, comprising:

a. a keel cooler for mounting onto the vessel hull, of a type including a plurality of flow channels for exchanging heat between vessel water flowing in the channels and surrounding sea water;

b. nozzles extending from first and second ends of the keel cooler, for allowing the sea water to flow between the vessel and the keel cooler;

c. companion fittings mounted on the vessel hull for receiving the nozzles extending from the first and second ends of the keel cooler;

d. a bushing positionable between each nozzle and each companion fitting;

e. at least one sealing member positioned between each bushing and each nozzle to provide a fluid tight seal therebetween;

f. at least one sealing member positioned between each bushing and each companion fitting to provide a fluid tight seal therebetween; and g. each bushing comprising a wall portion for further defining an eccentric circular wall, so that in the event the openings in the companion fittings on the hull are not precisely the same distance apart as nozzle openings on the keel cooler, the bushing is rotatable until the eccentric wall fully engages the sealing members positioned between the bushings and the nozzles and the bushings and the companion fittings to define a complete fluid seal therebetween.

* * * * *